US005783542A

United States Patent [19]

Rouillard

[11] Patent Number: 5,783,542

[45] **Date of Patent: *Jul. 21, 1998**

[54] ANIONIC STABILIZED ENZYME BASED CLEAN-IN-PLACE SYSTEM

[75] Inventor: Carol A. Rouillard, Taylor, Mich.

[73] Assignee: Diversey Lever, Inc., Plymouth, Mich.

[ * ] Notice: The term of this patent shall not extend beyond the expiration date of Pat. No. 5,571,446.

[21] Appl. No.: 660,530

[22] Filed: Jun. 7, 1996

Related U.S. Application Data

[63] Continuation-in-part of Ser. No. 508,124, Jul. 27, 1995, Pat. No. 5,571,446.

[51] Int. Cl.[6] ..... C11D 17/00; C11D 17/04; C11D 3/00

[52] U.S. Cl. ..... 510/234; 510/277; 510/300; 510/321; 510/393

[58] Field of Search ..... 510/234, 277, 510/300, 321, 393

[56] References Cited

U.S. PATENT DOCUMENTS

| | | | |
|---|---|---|---|
| 2,333,689 | 11/1943 | Sigoda | 112/79 |
| 3,472,783 | 10/1969 | Smillie et al. | 252/89 |
| 4,081,395 | 3/1978 | Talley | 252/106 |
| 4,169,817 | 10/1979 | Weber | 252/545 |
| 4,212,761 | 7/1980 | Ciaccio . | |
| 4,243,543 | 1/1981 | Guilbert et al. | 252/105 |
| 4,624,803 | 11/1986 | Balzer et al. | 252/527 |
| 4,844,744 | 7/1989 | Leiter et al. | 134/40 |
| 4,935,065 | 6/1990 | Bull | 134/22.13 |
| 5,064,561 | 11/1991 | Rouillard | 252/174.12 |
| 5,192,677 | 3/1993 | Kinsella et al. | 435/220 |
| 5,288,420 | 2/1994 | Mandy | 252/121 |

FOREIGN PATENT DOCUMENTS

| | | |
|---|---|---|
| 1179955 | 12/1984 | Canada . |
| 1228042 | 10/1987 | Canada . |
| 1304029 | 6/1992 | Canada . |
| 2259201 | 12/1972 | Germany . |
| WO9211347 | 7/1992 | WIPO . |
| WO9311212 | 6/1993 | WIPO . |
| WO9321299 | 10/1993 | WIPO . |
| WO9404665 | 3/1994 | WIPO . |
| WO9422993 | 10/1994 | WIPO . |
| WO9423005 | 10/1994 | WIPO . |

*Primary Examiner*—Mukund J. Shah
*Assistant Examiner*—Brenda Coleman
*Attorney, Agent, or Firm*—A. Kate Huffman

[57] ABSTRACT

A two-part enzyme-based cleaning system useful in clean-in-place operations to remove proteinaceous soils from dairy equipment is described. The system comprises two liquid concentrates stored in separate containers, the concentrates being diluted and mixed for use.

A. The first concentrate consists of:
  i) 1.5 to 7.5 percent by weight of a source of alkalinity selected from the sources of hydroxide based alkaline compositions;
  ii) 1 to 16 percent by weight of a water conditioner selected from the group consisting of polyacrylic acids and polyphosphates; and
  iii) balance water.

B. The second concentrate consists of:
  i) 5 to 45 percent by weight of an enzyme stabilizing blend of an alkali salt of a ($C_6$ to $C_{12}$) fatty acid and a linear ($C_8$–$C_{18}$) polyoxyalkylene alcohol;
  ii) an effective amount of a proteolytic enzyme; and
  iii) optionally, an enzyme compatible non-aqueous polyol filler; and
  iv) balance water

12 Claims, No Drawings

ANIONIC STABILIZED ENZYME BASED CLEAN-IN-PLACE SYSTEM

This application is a continuation-in-part of U.S. application Ser. No. 08/508,124 filed Jul. 27, 1995 U.S. Pat. No. 5,571,446.

FIELD OF THE INVENTION

This invention relates to an enzyme-based cleaning system for use in clean-in-place operations to remove protein based soils.

BACKGROUND OF THE INVENTION

Proteolytic enzymes have been used extensively in alkaline detergent formulations to aid in the removal of protein-based stains which tend to adhere to textile surfaces. The most common type of formulation, which employs enzymes of this nature, are solid based detergents. The enzyme in its solid stable form is mixed with alkaline solid detergent formulations containing the usual surfactants, anti-redeposition agents, water hardness control agents, other chelators and the like. Solid enzymes in this type of formulation have very reliable stability over extended periods. Hence, the solid enzyme based detergent products can be packaged and stored for extended periods before use.

There are, however, many cleaning situations where an enzyme based alkaline detergent is preferably in liquid form. Such liquid forms of detergents are more readily diluted and dispersed in the cleaning formulations. They are particularly useful in cleaning of textiles because they may be applied in concentrated liquid form before the normal cleaning process. Considerable effort and interest has been pursued in formulating enzyme based cleaning systems which are in a liquid form. There is, however, a significant difficulty in maintaining enzyme activity in liquid based detergents. It is well known that cationic and the most common anionic surfactants attack enzymes, breaking them down and rendering them non-active. It is generally understood, however, that nonionic surfactants can be used in conjunction with enzymes and not appreciably affect the activity of the enzyme in a liquid formulation. It is also generally understood that the presence of water in a liquid enzyme formulation causes degradation of the enzymes by self-digestion which is commonly referred to as autolysis. The presence of oxygen in the liquid formulation can also present a significant problem because oxygen can denature the enzymes. The presence of oxygen is normally controlled by the use of antioxidants. However, the introduction of antioxidants to the composition can over time cause the pH of the composition to drop well below the normal alkaline pH range in which the enzymes are active. By virtue of the pH dropping, the enzymes become inactive.

However, in view of the significant interest in liquid detergents containing enzymes, several approaches have been taken to stabilize the enzyme composition so that the enzymes are active in use.

Enzyme detergent formulations have also become useful in clean-in-place operations where it is desired to remove protein-based deposits on various types of processing equipment such as dairy equipment. Quite often in dairy processing, high temperatures are used which results in the deposit of difficult to remove soils on internal surfaces of processing equipment. Removal is normally accomplished by the use of highly alkaline or highly acidic compositions. Such compositions, although successful in removing deposited materials, are somewhat hazardous to use and must be neutralized before being discarded. Furthermore, the highly alkaline or acidic cleaning compositions are very corrosive and can attack components of the processing equipment. Alternatives have therefore been sought.

U.S. Pat. No. 4,212,761 describes a composition which is useful in cleaning processing equipment in dairy production. The enzyme is particularly useful in dissolving milkstone deposits and other dairy deposits on interior surfaces of the processing equipment. The composition is very useful for a clean-in-place process; however, the composition is supplied in solid form and dissolved on site in water before use. Such solid composition consists essentially of a nonionic or anionic detergent, sodium carbonate or sodium bicarbonate and an alkaline protease. In solid form, the enzyme is stable even in the presence of the anionic detergent material. The nonionic or anionic detergent material is employed solely to act as a detergent to facilitate the cleaning action where it is thought that any suitable nonionic or anionic detergent material may be used. The preferred form of enzyme is a proteolytic enzyme which is capable of breaking down the deposited milk solids, particularly in the form of milkstone. Having to make up the composition on site significantly complicates the administration of the cleaning composition in a clean-in-place operation. Liquid formulations are far superior in this regard since they may be stored in drums and automatically dispensed as needed during the clean-in-place operation.

U.S. Pat. Nos. 4,243,543 and 5,064,561 recognize the advantages of liquid compositions for clean-in-place systems and describe two-part compositions which are kept separate until they are combined and diluted for use in the clean-in-place operation. U.S. Pat. No. 4,243,543 recognizes the significant problem in stabilizing enzymes in an aqueous system. In order to achieve such stabilization in an aqueous solution which may contain up to the perceived maximum of 30% by weight water, an antioxidant is used to enhance stability of the enzyme in the aqueous system. The enzyme-containing part of the composition comprises the proteolytic enzyme, an anionic and/or nonionic surfactant and the antioxidant with the balance being water. Because of the use of the antioxidant, the aqueous solution is not pH stable. The antioxidant will cause the pH of the solution to drop, thereby rendering the enzyme inactive over time. In order to maintain the pH of the composition in the desired range of 5.2 to 9 and avoid downward pH shifts, a buffering amount of a weak base is included to stabilize pH. The buffer may be any of the well-known compositions capable of stabilizing pH, such as carbonates which have a pKa within the range of about 6 to 12. In addition to further stabilize the enzyme in this composition, a water soluble polyol containing from 2 to 6 hydroxyl groups and having a molecular weight of less than 500 is used to achieve a stable composition for storage. The second component for this two-part cleaning system comprises a chelant or sequestering agent for sequestering the alkaline earth metal cations in the plant water used to dilute the two parts when combined during the clean-in-place operation.

U.S. Pat. No. 5,064,561 discloses a two-part clean-in-place system which provides for stability of the enzyme in the second concentrated solution by ensuring that the concentrate is substantially absent of free water and the enzyme is combined with a carrier such as alcohols, surfactants, polyols, glycols and mixtures thereof. The first concentrate comprises a hydroxide-based alkaline material, a defoamer, a solubilizer or emulsifier and a water hardness control additive. The defoamer is used to control foaming as caused by the presence of the protease in the second concentrate. It is suggested, however, that the defoamer is optional if a liquid form of the enzyme is used in the second concentrated solution. However, the second concentrate still requires that the liquid form of the enzyme be absent of any free water as it would apply to both the source of enzyme and carrier. Although this is a successful two-part clean-in-place system, it is difficult to supply the second concentrate containing the enzyme which is essentially absent of any free water.

It would therefore be beneficial if a two-part clean-in-place system particularly for use in cleaning dairy equipment could be made where water is present in the second concentrate containing the enzyme and where stability of the enzyme in the concentrate is maintained to ensure proper shelf life.

SUMMARY OF THE INVENTION

The composition in accordance with this invention provides two concentrates containing a minimum of components which surprisingly provide very effective cleaning for clean-in-place operation. The second concentrate now includes water while maintaining acceptable enzyme activity.

In accordance with an aspect of the invention, a two-part enzyme based cleaning system comprises the first and second liquid concentrates stored in separate containers where the concentrates are used in preparing a dilute use solution.

A. The first concentrate consists of:
- i) 1.75 to 7.5 percent by weight of a source of alkalinity selected from sources of hydroxide-based alkaline compositions;
- ii) 1 to 16 percent by weight of a water conditioner selected from the group consisting of polyacrylic acids and polyphosphates; and
- iii) balance water;

B. The second concentrate consists of:
- i) 5 to 45 percent by weight of an enzyme stabilizing blond of an alkali salt of a ($C_6$–$C_{12}$) fatty acid and a linear ($C_8$–$C_{18}$) polyoxyalkylene alcohol;
- ii) an effective amount of a proteolytic enzyme;
- iii) optionally, an enzyme compatible non-aqueous liquid polyol filler; and
- iv) balance water.

DETAILED DESCRIPTION OF THE PREFERRED EMBODIMENTS

Although the two-part clean-in-place composition, in accordance with this invention, is particularly useful in cleaning of dairy processing equipment particularly as a composition used in a clean-in-place system, it is understood that the composition may also be used in other cleaning operations where enzyme activity is desired, such as in laundry formulations, surface cleaning formulations and the like. Examples of surface cleaning include removal from process equipment surfaces of brewing wort, food soils from processed foods, beverage soils (e.g., fruit juices, orange juice, juice drinks and beverages), blood in meat plants, milk based soils commonly found in the dairy industry, such as ice cream, milk, flavored milk, cream, buttermilk and the like and pharmaceutical products. The composition contains a minimum of components, yet surprisingly achieves cleaning activity comparable to the far more complex multi-additive systems of the prior art, such as described in U.S. Pat. Nos. 4,243,543 and 5,064,561 and other forms of highly alkaline cleaners. It is understood that other components for purposes other than achieving enzymatic attack of proteinaceous materials may be added to the composition.

The essential aspect of the invention resides in the provision of a first concentrate which contains only two active ingredients and a second concentrate which contains only two different active ingredients. In both concentrates, the active ingredients are solubilized in water to provide the desired liquid concentrates. It has been found that with the ingredients used in the second concentrate, acceptable enzyme stability is achieved even though the active ingredients employed would, as suggested by the prior art, presumably break down the enzyme and render the enzyme inactive. However, surprisingly, the selected components of the blend which forms the first ingredient of the second concentrate stabilizes the enzyme and ensures its activity when used with the first concentrate to provide a diluted solution effective for use in a clean-in-place operation. In circumstances where very high levels of enzyme dilution are required in the second concentrate, enzyme compatible non-aqueous fillers may be used.

As is generally understood, enzyme activity can vary greatly based on the source of the enzyme either extracted from natural sources or isolated from a culture of bacteria which under appropriate conditions manufacture the enzyme. The main objective is to provide in the second concentrate sufficient active enzyme which, when provided in the use dilution, is able to digest the proteinaceous soils and provide the desired cleaning action. Hence, depending upon the source of the enzyme, usually by suitable trial and error, a sufficient amount is incorporated in the concentrate to provide the desired cleaning. It has been found that the second concentrate, which contains the enzyme, is sufficiently stabilized by the blend of ingredients that after considerable storage time, sufficient activity remains to effect the desired cleaning. For example, it has been found that storage of the second concentrate at normal storage temperatures for up to three months does not greatly affect the enzyme activity. Even storage at these temperatures of up to six months still provide a sufficiently active enzyme to effect the desired cleaning. The activity of the enzyme is such that very little of the enzyme is required in the use solution. Hence if there is a falling off of activity in the second concentrate over greatly extended periods, that is well in excess of six months, the amount of second concentrate used in the use solution may be slightly increased to ensure that there is still sufficient active enzyme in the use solution to achieve the desired cleaning effectiveness.

Furthermore, it has been found that the enzyme in combination with the blend of materials in the second concentrate does not have a foaming problem which was normally associated with the presence of proteinaceous material. Hence defoamers and the like are not needed in the first concentrate to deal with the proteinase material present in the second concentrate. In view of the stabilizing effect in the second concentrate, it has been found that antioxidants and consequent required buffers and the like are not required in the composition. The first and second concentrates, in accordance with this invention, provide a cleaning system which includes fewer ingredients and is therefore more cost effective for use in cleaning operations.

In the second concentrate, the blend of active ingredients which provides for the stability of the proteolytic enzyme, is a combination of an alkali salt of a ($C_6$–$C_{12}$) fatty acid and a linear ($C_8$–$C_{18}$) polyoxyalkylenealcohols. The fatty acid is preferably $C_8$–$C_{10}$ such as octanoic acid, nonanoic acid and decanoic acid. The preferred alkali salts thereof are potassium and sodium. The linear polyoxyalkylene is considered to be a nonionic with $C_8$ to $C_{18}$ carbon atoms in the linear alkyl chain, where the chain terminating in alcohol, is usually either ethoxylated and/or propoxylated. The components of the blend can be readily obtained from a host of suppliers of anionic and nonionic surfactants. This blend of components has been found to be compatible with the selected proteolytic enzyme, such that when stored in water is not attacked by the blend and prevents autolysis in the water so that the enzyme activity is maintained during a normal shelf life expectancy period.

The preferred enzyme is an endoproteinase of the serine type. The effective amount of the enzyme in the concentrate is sufficient to provide the desired degree of activity which is usually in excess of 85% of the original activity as previously described. The preferred enzyme is sold under the trademark ESPERASE and may be obtained from Novo Industries of Denmark. The enzyme is prepared by submerged fermentation of a selected microorganism that can be classified as an alkalophilic species of Bacillus. This type of enzyme has a very broad substrate specificity and is capable of hydrolyzing most peptide bonds within a protein molecule.

The first concentrate consists of 1.75% to 7.5% by weight of the concentrate of an hydroxide-based alkaline composition. Preferred hydroxides for the alkaline composition are potassium and/or sodium hydroxide. The alkaline composition preferably includes just the hydroxide, but in some use situations, may include other alkalinity enhancers. Although in keeping with a preferred aspect of the invention, additives and enhancers can be avoided.

The water conditioner is preferably from 1 to 16% by weight of the concentrate. The water conditioner is selected from the group of polyphosphates and polyacrylic acids. The polyacrylic acids act as anti-redeposition agents and have a molecular weight ranging from 3000 to 6000 where the preferred polyacrylate is a homopolymer sold under the trademark ACUSOL 445 by Rohm and Haas Company. Other polyacrylates include copolymers of acrylic acid, maleic acid and other olefins and terpolymers which are a mixture of monomers. The polyacrylate is normally available in a solution, where the solution is 48% polyacrylic acid and the balance water. Other forms of water conditioners include various polyphosphates, such as sodium tripolyphosphate and potassium tripolyphosphate.

It has been found that, when the diluted second concentrate is mixed with the diluted first concentrate, enzyme activity is not affected where a sufficient amount of hydroxide is used, such that the pH of the use solution is in the desired range of about 9 to about 10. Because antioxidants and the like are not used in the composition, pH stabilizing materials, such as sodium carbonate and sodium bicarbonates, are not required. This lack of buffers is, of course, to be distinguished from the use of carbonates as a source of alkalinity where the amounts of carbonates and bicarbonates greatly exceed the amount which would be used when they could only act as a buffer in addition to an alternative source of alkalinity. Furthermore, in the use of the two-part composition as a clean-in-place system, other water hardness control agents are optional.

The order of addition of the concentrates to water for end use is, as would be expected, conducted in a manner to protect the activity of the enzyme. Since the first concentrate has a high pH, it would, as one skilled in the art appreciates, be detrimental to the enzyme activity to combine it directly with the first concentrate before dilution. The high pH in the first concentrate would greatly reduce the activity of the enzyme. Alternatively if the second concentrate were first diluted and then the first concentrate added to the diluted second concentrate, there is also the possibility of reducing enzyme activity, because the introduced first concentrate of high pH may in localized regions of the diluted second concentrate attack the enzyme and reduce its activity. The preferred order of diluting the concentrates is as follows. The first concentrate is diluted to the desired use solution range. Then the second concentrate is added to the diluted first concentrate to minimize any possibility of affecting enzyme activity. The rate of addition of the second concentrate to the diluted first concentrate can vary depending upon the manner in which the use solution is formulated; that is either by injection or mixing in a stir tank.

Preferred amounts in the first concentrate of the alkaline material is approximately 2.5% and of the polyacrylic acid of about 4%. In the second concentrate, the preferred amount of the enzyme stabilizing blend is approximately 40% by weight and sufficient enzyme to provide the desired activity level.

The use solution provided by diluting the first and second concentrates with water provides from about 0.02 to 1% by weight of the total weight of the use solution of the first concentrate, and about 0.0002 to 0.05% by weight (2 ppm to 500 ppm) of the second concentrate. The preferred weight range for the first concentrate in the use solution is about 0.04 to 0.6% by weight of solution and about 0.005% to 0.11% by weight (50 ppm to 1100 ppm) of the second concentrate. The use solution is circulated through the equipment in the normal clean-in-place process. The preferred temperature for the use solution to effect optimum enzyme activity is in the range of 50° C. to 60° C. where the pH is preferably in the range of 8.5 to 10.5. The use solution is considerably less alkaline than the previous use solutions, particularly the highly alkaline cleaning solutions. The use solution of this invention, with the minimum number of components, still achieves the desired cleaning times within the range of 10 to 30 minutes.

Although it has been previously thought that enzymes for use in broad range proteolytic activities were not stable in aqueous compositions, which contained more than 30% by weight of water, it has been found that with the composition of this invention, the second concentrate provides a stable enzyme composition under normal storage conditions. The amount of water in the second concentrate may be well in excess of 30% and may be as high as approximately 65% by weight of water. Such high water levels in the second concentrate permits the use of off-the-shelf supplies for both the blend of anionic detergent and liquid forms of the enzyme. The enzyme composition, as commercially obtained from Novo for example, may have considerable quantities of water. A further improvement in this composition is in respect of providing a more dilute second concentrate to facilitate more accurate dispensing of the enzyme into the use solution. With certain types of metering devices, it is more accurate to dose into the use solution larger volumes of the first and second concentrate, particularly the second concentrate containing the enzyme in view of the need to control and provide the correct amount of enzyme in the use solution. The enzyme is stabilized by the blend of the alkali salt of a fatty acid and the linear polyoxyalkylene alcohols. With the enzyme stabilized, the amount of water in the concentrate could be increased to further dilute the concentration of the enzyme in the second concentrate. However, such extreme dilutions with water and a neutral pH containing composition can lead to phase stability problems. Applicant has now found that further dilution with water can be avoided by using suitable non-aqueous fillers which are compatible with the enzyme.

maintains phase stability and optionally provides anti-freeze properties. Such suitable non-aqueous fillers are polyols, preferably with 2 to 6 carbon atoms. Examples include propylene glycol, 1,2-propane-diol, butylene glycol, ethylene glycol, hexeleneglycol, erythritol, fructose, glucose, glycerol, lactose, mannitol and sorbitol. The use of the non-aqueous filler maintains an acceptable ratio of enzyme to water while at the same time providing a more dilute concentration of the enzyme in He second concentrate to facilitate more accurate dosing by dispensing at each opportunity a greater volume of the second concentrate. By using the non-aqueous filler, not only is the ratio of enzyme to stabilizing blond and ratio of enzyme to water kept in line, but as well the ratio of the stabilizing blend to water is also kept in range to ensure shelf-life of the more dilute enzyme in the concentrate and reduce the risks of freezing and phase instability.

The cleaner, according to this invention, has many significant business advantages. Prom a production standpoint, a very trim formulation in the sense of very few ingredients is provided so that manufacture of the cleaner is greatly facilitated. There is no requirement to add various additives to maintain enzyme stability, other than the unique formulation provided in the form of a single blend which is combined with the enzyme Production is greatly facilitated in that water is now accommodated in the formulation. From the standpoint of commercial use of the cleaner, the system, when cleaning, functions at a considerably reduced pH compared to the well known chlorinate alkaline cleaners. Hence less treatment is required to discharge the cleaning effluent. It has also been found that the cleaner, in accordance with this invention, may be used to clean a variety of other pieces of food handling equipment which contain a variety of other forms of proteinaceous soils; for example, juice dispensing systems, ice cream manufacturing equipment, fast food preparation equipment, brewery fermentation and liquid handling equipment, and even equipment which handles high fat, low protein food materials such as cream handling equipment. It is quite surprising that the formulation of this invention is successful in cleaning tank, processing equipment and the like which handles cream. Cream is very high in fat, usually 40% or more but has a very low protein content. Normally to clean cream from surfaces of processing equipment, a chlorinated alkali material or solvent is required. As already noted, these cleaners require considerable processing and treatment before release to the environment. Surprisingly, the cleaner of this formulation which is low in pH and does not include a solvent works quite effectively in removing cream residues from surfaces of the handling equipment. Hence the cleaning formulation of this invention is commercially quite usable in that a single cleaner can be used for a variety of cleaning tasks in a food processing facility. This greatly reduces costs in overall cleaning management of the food processing equipment as well as providing much greater safety in the handling of the cleaning composition, certainly compared to the far more hazardous cleaners, such as chlorinated alkali.

Exemplary compositions for the first and second concentrates are provided in the following Tables 1 and 2. The various concentrates as diluted were used in accordance with the following tests to give the results provided in Table 3.

TABLE 1

| Component 1 of Detergent System | | | | | |
|---|---|---|---|---|---|
| Material | A | B | C | D | E |
| Water | 87.7 | 86.5 | 85.5 | 86.7 | 84.0 |
| Sodium Hydroxide, 50% solution | 4.3 | 0.0 | 0.0 | 4.3 | 8.0 |
| Potassium Hydroxide, 45% solution | 0.0 | 5.5 | 5.5 | 0.0 | 0.0 |
| Acusol 445[A] | 8.0 | 8.0 | 8.0 | 8.0 | 8.0 |
| Alkali surfactant[B] | 0.0 | 0.0 | 1.0 | 1.0 | 1.0 |

[A]- polyacrylic acid with an active molecular weight of 4500, 48% solution sold by Rohm and Haas Co.
[B]- Isodecyoxypropylaminodipropionic acid amphoteric surfactant sold under the name Alkali Surfactant by Tomah Products, Inc.

Typical use concentration of above is 0.4–0.8% v/v.

TABLE 2

| Component 2 of Detergent System | | | |
|---|---|---|---|
| Material | A | B | C |
| Water | 0.0 | 10.0 | 0.0 |
| Anionic surfactant | 80.0 | 80.0 | 0.0 |
| Serine endoprotease[C] | 20.0 | 10.0 | 100.0 |

[C]- Sold as ESPERASE 8.0 L by Novo Industries

Typical use concentration of Component 2 is 0.005 to 0.02% v/v

A series of tests were performed in which cleaning solutions were prepared by diluting one example of Component 1 from Table 1 in water and adding an example of Component 2 from table 2. Stainless steel panels (3"×6" in size) of type 316 (2B finish) were thoroughly precleaned in a hot chlorinated alkaline solution and then handwashed with a sponge and hand dishwashing detergent. When rinsed with water, clean panels exhibit complete water sheeting, or what is often called a water break free surface. Panels that are not completely clean are recognized by breaks in the sheeting action. For the purposes of this evaluation, the panels were evaluated after each of ten cleaning cycles for a water break free surface.

The panels were suspended from a rod and hook assembly and were soiled by completely immersing them in homogenized, pasteurized whole milk held at 8° to 12° C. for 10 minutes. They were then removed from the milk, rinsed and immediately suspended for a period of 10 minutes in test solution held at 60° C. After cleaning, they were thoroughly rinsed with cold tap water, followed by a deionized water rinse. The sheeting action of the water was noted at this point. This procedure was repeated 9 more times, for a total of 10 cleaning cycles. A final evaluation was done by soaking the panels in a solution of dye that stains organic soils red. Panels that exhibited complete water sheeting after every cycle and did not retain any red dye were deemed efficacious. A chlorinated alkaline cleaner "INTEREST", available from Diversey Inc., was used as the positive control.

Table 3 shows some test results, indicating the combination of components used; test temperature, water hardness level and result.

TABLE 3

Sample Cleaning Test Results

| % v/v Component 1 | % v/v Component 2 | °C. | water hardness (as ppm $CaCO_3$) | Effective |
|---|---|---|---|---|
| 0.8% of B | 0.01% of A | 60 | 500 | Yes |
| 0.4% of C | 0.01% of A | 60 | 100 | Yes |
| 0.4% of D | 0.01% of A | 60 | 300 | Yes |
| 0.4% of A | 0.01% of A | 65 | 100 | Yes |
| 0.4% of B | 0.01% of B | 60 | 100 | Yes |
| 0.4% of E | 0.01% of A | 60 | 100 | Yes |
| 0.4% of A | 0.002% of C | 60 | 100 | No |

(The last example shows that enzyme alone is not an effective cleaner, and that the stabilizing blend is a necessary part of the formulation for Component 2).

To illustrate sufficient product stability of Component 2 (which does not contain any traditional enzyme stabilizers), the following test example is offered:

TABLE 4

| % v/v Component 1 | % v/v Component 2 | °C. | water hardness (as ppm $CaCO_3$) | Effective |
|---|---|---|---|---|
| 0.4% of A | 0.01% of A | 60 | 100 | Yes |

where the product concentrate A (component 2) was stored for at least 3 months at 25° C. without protection from light.

A representative composition for the second concentrate is set out in the following Table 5.

TABLE 5

| MATERIAL | % wt. |
|---|---|
| Water | 37.5 |
| Propylene glycol | 37.5 |
| Esperase 8.0 L | 5.0 |
| Anionic blend | 20.0(d) |

(d)- 50% by weight in water

In view of the anionic blend being in an aqueous solution, the actual amount of water in the composition is 47.5% by weight and the active amount in the anionic blend is 10% by weight.

The two-part enzyme-based cleaning system comprising the first and second liquid concentrates may have a range in respect of percent by weight of the active components of each concentrate. Such ranges are exemplified by the above examples. The preferred percent by weight of the source of alkalinity is about 2 to 4%. The preferred percent by weight of the water conditioner is about 4 to 6%. In the second concentrate, the preferred weight of the enzyme stabilizing blend for the more concentrated solution is 35 to 45% by weight, whereas when it is desired to have a more diluted concentration of the enzyme, the blend may be in the range of 10 to 20% by weight. The percent by weight of the non-aqueous liquid filler, when more dilute concentrations of the enzyme are desired is normally in the range of 25 to 55% by weight.

Although preferred embodiments of the invention are described herein in detail, it will be understood by those skilled in the art that variations may be made thereto without departing from the spirit of the invention or the scope of the appended claims.

I claim:

1. A two-part enzyme-based cleaning system comprising first and second liquid concentrates stored in separate containers for use in preparing a dilute use solution, A. the first concentrate consisting of:

i) 1.75 to 7.5 percent by weight of a source of alkalinity selected from the sources of hydroxide based alkaline composition;

ii) 1 to 16 percent by weight of a water conditioner selected from the group consisting of polyacrylic acids and polyphosphates;

iii) balance water, and

B. the second concentrate consisting of:

i) 5 to 45 percent by weight of an enzyme stabilizing blend of an alkali salt of a ($C_6$ to $C_{12}$) fatty acid and a linear ($C_8$–$C_{18}$) polyoxyalkylene alcohol;

ii) an effective amount of a proteolytic enzyme;

iii) water and optionally an enzyme compatible non-aqueous liquid polyol filler; and iv) balance water.

2. A two-part system of claim 1, wherein said first concentrate, said alkaline composition is selected from the group consisting of sodium hydroxide and potassium hydroxide.

3. A two-part system of claim 1, wherein said first concentrate, said polyacrylic acid has a molecular weight of about 3000 to 6000.

4. A two-part system of claim 1, wherein said first concentrate, said polyphosphate is selected from the group consisting of sodium tripolyphosphate and potassium tripolyphosphate.

5. A two-part system of claim 1 having 35 to 45% of said blend and only water.

6. A two-part system of claim 4, wherein said second concentrate, said linear ($C_8$–$C_{18}$) polyoxyalkylene is a $C_8$–$C_{18}$ ethoxylated propoxylated alcohol.

7. A two-part system of claim 4, wherein said proteolytic enzyme is an endoproteinase of the serine type.

8. A two-part system of claim 4, wherein said first concentrate consists of about 2.5% of said source of alkalinity and about 4.5% of said polyacrylic acid.

9. A two-part system of claim 4, wherein said second concentrate consists of about 40% of said blend and about 0.8% of said enzyme.

10. A two-part system of claim 1 having 10 to 20% by weight of said blend, 30 to 40% of said selected filler and the balance water.

11. A two-part system of claim 10 wherein said selected polyol is propylene glycol.

12. A two-part system of claim 10 wherein said selected polyol is sorbitol.

* * * * *